United States Patent [19]

Quack et al.

[11] Patent Number: 4,756,933

[45] Date of Patent: Jul. 12, 1988

[54] PROCESS OF APPLYING AN INSULATING LAYER

[75] Inventors: Günther Quack, Berkeley Hights, N.J.; Heribert Domes, Weilmünster, Fed. Rep. of Germany

[73] Assignee: Metallgesellschaft Aktiengesellschaft, Frankfurt am Main, Fed. Rep. of Germany

[21] Appl. No.: 886,547

[22] Filed: Jul. 16, 1986

[30] Foreign Application Priority Data

Jul. 17, 1985 [DE] Fed. Rep. of Germany ..... 3525430
Nov. 9, 1985 [DE] Fed. Rep. of Germany ..... 3539774

[51] Int. Cl.[4] ..... B05D 3/01

[52] U.S. Cl. ..... 427/388.4; 148/6.15 R; 427/359; 427/428

[58] Field of Search ..... 427/388.4, 359; 148/6.15 R

[56] References Cited

U.S. PATENT DOCUMENTS

| | | | |
|---|---|---|---|
| 3,908,066 | 9/1975 | Parkinson | 427/388.4 |
| 4,103,049 | 7/1978 | Nishida et al. | 427/341 |
| 4,148,948 | 4/1979 | Williams | 427/388.4 |
| 4,238,533 | 12/1980 | Pujol et al. | 427/359 |
| 4,618,377 | 10/1986 | Nakamura et al. | 148/6.15 R |
| 4,985,131 | 11/1984 | Adams et al. | 427/388.4 |
| 9,636,265 | 1/1987 | Fischer et al. | 148/6.15 R |

FOREIGN PATENT DOCUMENTS

| | | |
|---|---|---|
| 0132828 | 2/1985 | European Pat. Off. . |
| 0209940 | 7/1986 | European Pat. Off. . |
| 1249965 | 3/1968 | Fed. Rep. of Germany . |
| 2336142 | 1/1975 | Fed. Rep. of Germany . |
| 2638712 | 3/1977 | Fed. Rep. of Germany . |
| 2058055 | 5/1971 | France . |

*Primary Examiner*—Thurman K. Page
*Assistant Examiner*—L. R. Horne
*Attorney, Agent, or Firm*—Karl F. Ross; Herbert Dubno

[57] ABSTRACT

A process is disclosed for applying to sheet steel an electrically insulating layer which permits mainly a satisfactory welding of the sheets when they have been blanked and stacked. The sheet steel is contacted with a treating liquor which contains a resin that is adapted to be diluted in an alkaline aqueous medium and also contains a fluoride of a polyvalent metal, particularly aluminum fluoride, in an amount of 0.1 to 80 parts by weight per 100 parts by weight resin. The treating liquor is subsequently dried and the sheet is subjected to a stress-relieving annealing, if required.

In preferred embodiments of the invention a treating liquor is employed which additionally contains borates and/or dispersed particles comprising silicate and/or polymers and which is applied by means of rollers and is dried at 120° to 350° C.

16 Claims, No Drawings

PROCESS OF APPLYING AN INSULATING LAYER

FIELD OF THE INVENTION

This invention relates to a process of applying an electrically insulating layer to sheet steel by means of a resin-containing aqueous treating liquor, which is dried when it has been applied.

BACKGROUND OF THE INVENTION

In the manufacture of iron cores, e.g., for motors, transformers and the like, it is known to provide electric sheet steel with an insulating layer, subsequently to blank the sheet steel, to stack the blanks and to join them by welding at their edges. The insulating layer which has been applied has a certain insulation resistance and has a substantial influence on the edge life of the blanking tools, i.e., on the time after which the tool must be re-sharpened. Important criteria for the quality of the insulating layer are its behavior during the stress-relieving annealing, which is required in most cases, and its influence on the seam weld formed as the blanks are welded.

Such insulating materials may be inorganic and may be formed, e.g., by means of treating liquors which contain chromic acid and/or phosphoric acid and/or phosphates. Whereas such layers usually have a satisfactory insulating resistance, the wear of the blanking tools will generally be relatively high in such cases and the use of chromic acid is not desirable from an ecological aspect.

Another kind of insulating layers are formed by an application of treating liquors which contain organic resins and optional inorganic additives and will, in many cases, result in a longer edge life of the tools; as a rule, however, their bond strength after the stress-relieving annealing and their influence on the formation of the seam weld are unsatisfactory.

It is an object of the invention to provide for the application of an electrically insulating coating on sheet steel a process which is free of the disadvantages of the above-mentioned processes and which can be used to form insulating layers which are satisfactory in every respect whereas additional process and equipment expenditures are not involved.

SUMMARY OF THE INVENTION

A process is disclosed for applying to sheet steel an electrically insulating layer which permits mainly a satisfactory welding of the sheets when they have been blanked and stacked. The sheet steel is contacted with a treating liquor which contains a resin that is adapted to be diluted in an alkaline aqueous medium and also contains a fluoride of a polyvalent metal, particularly aluminum fluoride, in an amount of 0.1 to 80 parts by weight per 100 parts by weight resin. The treating liquor is subsequently dried and the sheet is subjected to a stress-relieving annealing, if required.

In preferred embodiments of the invention a treating liquor is employed which additionally contains borates and/or dispersed particles comprising silicate and/or polymers and which is applied by means of rollers and is dried at 120° to 350° C.

DETAILED DESCRIPTION

In a process of the kind described first hereinbefore that object is accomplished in accordance with the invention in that the sheet steel is contacted with a treating liquor which contains a resin that is adapted to be diluted in an alkaline aqueous medium and said liquor also contains a fluoride of a polyvalent metal in an amount of 0.1 to 80 parts by weight per 100 parts by weight of resin.

The above statement that the resin is adapted to be diluted in an alkaline aqueous medium means that the resin must be soluble in such medium or must be adapted to be dispersed with a homogeneous distribution in such medium at least in a wide concentration range.

Particularly suitable resins are polyester resins, polyamide resins, epoxy resins, phenol resins, melamine resins and modified melamine resins, which resins may optionally contain neutralizable acid groups, as well as resins which with the aid of emulsifying agents can homogeneously be dispersed in an alkaline aqueous medium, such as latices based upon acrylates, styrene, butadiene or epoxy resins.

The fluoride of a polyvalent metal is particularly required for the formation of a satisfactory seam weld between the stacked blanks at an economically satisfactory welding speed. Suitable fluorides include particularly the fluorides of iron, manganese, barium, strontium, calcium, cerium and copper, individually or in combination.

In a preferred embodiment of the invention the sheet steel is contacted with a treating liquor which contains aluminum fluoride ($AlF_3$) as a fluoride of a polyvalent metal. In the presence of alkaline reacting additives, aluminum fluoride can easily form an aqueous dispersion. Where aluminum fluoride is used, very high welding speeds can be used without a risk of a formation of bubbles or weld globules.

In another desirable embodiment of the invention the treating liquor contains a fluoride of a polyvalent metal in an amount of 1 to 30 parts by weight of fluoride per 100 parts by weight of resin. This will result in optimum welding conditions.

In a further preferred embodiment of the invention the sheet steel is contacted with a treating liquor which additionally contains 0.1 to 40 parts by weight borate per 100 parts by weight resin. The borate may be added as boric acid or alkali metal borate. The borate content will particularly promote the bond strength of the coating, particularly if the resin component is decomposed during the subsequent treatment, e.g., during the stress-relieving annealing. In that case the borate will ensure that the iron oxide layer and any decomposition residue derived from the resin component and the fluoride component will adhere firmly to the metal surface whereas the formation of a freely flowable powder which can easily be removed will be avoided.

In a particularly desirable embodiment the treating liquor contains 1 to 10 parts by weight borate per 100 parts by weight of resin.

In a further preferred embodiment of the invention the sheet steel is contacted with a treating liquor which additionally contains dispersed particles which comprise silicate and/or polymer.

Such dispersed particles may consist of silicates of any desired origin or of any polymers which are stable in the treating liqouor, i.e., which are not soluble therein, and which can be formed into spherical bodies.

Particularly desirable results will be obtained if dispersed particles are used which consist of talcum or of polymers containing vinyl groups or substituted vinyl groups or of copolymers of polyvinylidene chloride or methyl methacrylate with acrylonitrile.

In particularly preferred embodiments the sheet steel is contacted with a treating liquor which contains the dispersed particles in an amount of 3 to 80 parts by weight, preferably 5 to 30 parts by weight, per 100 parts by weight of water-dilutable resin, and in which the dispersed particles have a particle size from 2 to 20 μm.

In a particularly preferred embodiment the treating liquors are free of chromium compounds, particularly of chromate compounds, so that the environment will not be affected in any manner and safety precautions will not be required in connection with the application of the treating liquor.

The treating liquor may contain additional additives known per se. Such additives suitably comprise substances which permit the treating liqour to be applied in a satisfactory manner, such as anti-settling agents, viscosity control agents, defoaming agents, wetting agents and leveling agents etc., as well as agents which reduce the friction during the blanking operation so that they will further reduce the wear of the blanking tools. Such agents may consist, e.g., of polypropylene waxes, polyamides or silicone oils.

In order to ensure that the resulting layer has the desired thickness, which is generally less than 10 μm and suitably below 4 μm (stated as the thickness of the dry film), and to simplify the application of the wet film required for that purpose, another preferred embodiment of the invention comprises a contacting of the sheet steel with a treating liquor which has a solids content of 20 to 80 wt. %. This will also afford the advantage that the evaporation of water and the transportation will not involve an excessively high expenditure.

The treating liquor may be applied in any desired manner, e.g., by dipping, spraying, or pulling through a treating container. It will be particularly desirable to contact the sheet steel with the treating liquor through means of rollers. In that case a wet film of constant thickness can be formed substantially independently of the viscosity of the treating liquor. For instance, in strip-coating processes the coating can be applied to the strip moving at a speed of and above about 120 m/sec. The layer is subsequently dried at a object temperature of 120° to 350° C., e.g., in a continuous furnace. The drying time may amount to about 20 seconds at 300° C.

When the sheets have subsequently been blanked, stacked and welded they may be put to the desired use without any further treatment. But it is generally recommendable to improve the magnetic properties by a stress-relieving annealing of the welded stacks of sheets. The annealing may be carried out at temperatures up to more than 600° C. in air or at temperatures up to more than 850° C. in a protective atmosphere.

An important advantage afforded by the invention resides in that electrically insulating coatings having a high insulating resistance can be applied to sheet steel in a simple manner and that the seam welds holding the stacks of sheets together can be formed at high speed. Owing to the use of aqueous systems, the precautions required with systems containing organic solvents are unnecessary. The resulting insulating layers are distinguished by having a high bond strength, which may be increased by the borate content of the treating liquor if a stress-relieving annealing is carried out. The coated sheet metal has very good blanking properties and can be blanked with blanking tools having a very long edge life.

An additional advantage afforded by the use of a treating liquor which contains dispersed particles that comprise silicate and/or polymer resides in that seam welds having a length increase of 10 to 20 times can be formed without a change of the electrodes when the stacked sheets are welded and formation of soot will be substantially avoided in such welding operation.

The preferred use of a treating liquor which is free of chromium compounds, particularly of chromates, affords the additional advantage that the environment will not be adversely affected and that the strip can be treated without a need for special precautions.

The invention will be explained in more detail with reference to non-limiting Examples.

EXAMPLE 1

100 parts by weight of a plasticized phenolic resin were mixed with 20 parts by weight aluminum fluoride (calculated as $AlF_3.3H_2O$), 7 parts by weight sodium borate (calculated as $Na_2B_4O_7.10H_2O$), 14 parts by weight dimethylethanolamine and 115 parts by weight de-ionized water.

0.5 parts by weight of a surfactant were added to the mixture in order to prevent foaming and to improve the wetting of the substrate.

That formulation was applied by means of a rubber roller to the surfaces on both sides of a silicon-alloyed electric sheet steel having a nominal thickness of 0.5 mm (grade V 700–50 A in accordance with DIN 46400, Part 1). To cure the coating the coated sheets were subsequently heated at a temperature of 300° C. for 20 seconds. Each dry layer had a thickness of 1 μm±0.2 μm.

The quality of the resulting insulating layer is apparent from the following Table 1.

EXAMPLE 2

40 parts by weight of a plasticized phenolic resin
25 parts by weight of an acrylate resin
35 parts by weight of a partly methylated melamine resin,
20 parts by weight aluminum fluoride (calculated as $AlF_3.3H_2O$),
7 parts by weight sodium borate (calculated as $Na_2B_4O_7.10H_2O$),
14 parts dimethylethanolamine, and
115 parts de-ionized water
were mixed.

0.5 parts by weight of a surfactant were added to the mixture in order to prevent foaming and to improve the wetting of the substrate.

The processing was effected under the conditions stated in Example 1. The results obtained are compiled hereinafter in Table 1.

EXAMPLE 3

60 parts by weight of a modified polyester resin
10 parts by weight of a melamine resin
20 parts by weight aluminum fluoride (calculated as $AlF_3.3H_2O$)
7 parts by weight sodium borate (calculated as $Na_2B_4O_7.10H_2O$)
14 parts by weight dimethylethanolamine and
115 parts de-ionized water
were mixed.

0.5 parts by weight of a surfactant were added to the mixture in order to prevent foaming and to improve the wetting of the substrate.

The treating liquor was also processed as described in Example 1. The results are stated in Table 1.

EXAMPLE 4

100 parts by weight of a plasticized phenolic resin
20 parts by weight aluminum fluoride (calculated as $AlF_3.3H_2O$)
14 parts by weight dimethylethanolamine and
115 parts by weight de-ionized water
were mixed.

0.5 parts by weight of a surfactant were added to the mixture in order to prevent foaming and to improve the wetting of the substrate.

The treating liquor was processed as described in Example 1.

CONTROL EXAMPLE 100 parts by weight of a plasticized phenolic resin
6 parts by weight dimethylethanolamine and
115 parts de-ionized water
were mixed.

0.5 parts by weight of a surfactant were added to the mixture in order to prevent foaming and to improve the wetting of the substrate.

The processing was as described in Example 1.

The results obtained in the several Examples are apparent from the subsequent Table 1.

The thickness of the dry layer is stated in line 1.

The interlaminar contact resistance, in $ohm \times cm^{-2}$ under a contact pressure of $100\ N \times cm^{-2}$ and at a voltage of 100 mV, is recorded at line 3 for the two insulating layers on the electric sheet before annealing.

The rating R 50 means that 50% of the measured values exceed the stated resistance value.

Recorded in line 4 is the contact resistance as explained for line 3 but after an annealing in air at 600° C. for one hour.

Corrosion resistance is recorded in line 5. That parameter was determined by the changing-atmosphere test in accordance with DIN 50017, in which the coated sheet was exposed to a relative humidity of 100% at 40° C. and then to a standard room atmosphere for 16 hours.

Bond strength is recorded at line 6, which also reflects the flexibility of the layer and was determined by bending tests using a conical mandrel.

In the cross hatch test giving the results stated in line 7, fields of 1 $mm^2$ were provided by crossing cuts extending to the surface of the metal. Adhesive tape was then applied and torn off and the number of damaged or peeled-off fields was determined.

The surface area of the coating is stated in line 8, and reflects coating adherence to the metal surface when the above mentioned tape test is applied after the sheet has been annealed in air at 600° C. for one hour.

The resistance to solvents stated in line 9 was determined on a certain portion of the coating by wiping 50 times with a cotton swab that had been soaked with methylene chloride ($CH_2Cl_2$) and recording any changes.

Line 10 indicates the highest permissible speed at which a satisfactory non-porous seam weld can be formed under an argon atmosphere when the stack of sheets is welded with a current of 90 to 120 amperes and under a contact pressure of $250\ N \times cm^{-2}$.

It is apparent from Table 1 that all results are satisfactory as regards the electrical contact resistance before and after the annealing (lines 3 and 4), the resistance to corrosion (line 5), the bond strength before the annealing (line 6), the cross hatch test (line 7) and the resistance to solvent (line 9). Compared to the Control Example in accordance with the prior art, the insulating layer applied in Example 4 (in which the treating liquor did not contain borate), did not have an optimum bond strength after an annealing treatment (line 8) but exhibited distinctly improved properties (line 10).

From Examples 1 to 5 which constitute the preferred embodiment of the invention, it is apparent that a maximum bond strength after annealing (line 8) can be achieved while still retaining greatly improved welding properties (line 10).

Regarding the contact resistance (lines 3 and 4) the results are consistent with the conventional requirements for insulated electric sheets.

The results of the cross hatch test (line 7) mean that no field had been damaged.

TABLE 1

| Properties | Example 1 | Example 2 | Example 3 | Example 4 | Control |
|---|---|---|---|---|---|
| Thickness of dry layer | ±0.2 1 μm | ±0.2 1 μm | ±0.2 1 μm | ±0.2 1 μm | ±0.2 1 μm |
| Contact resistance before annealing (ohms) | R 50 $>10^2$ | R 50 $>10^2$ | R 50 $>10^2$ | R 50 $>10^2$ | R 50 $>10^2$ |
| Contact resistance after annealing (ohms) | R 50 $>10^2$ | R 50 $>10^2$ | R 50 $>10^2$ | R 50 $>10^2$ | R 50 $>10^2$ |
| Corrosion resistance | no rusting | no rusting | no rusting | no rusting | no rusting |
| Bond strength before annealing | <3 mm | <3 mm | <3 mm | <3 mm | <3 mm |
| Cross hatch test DIN 53151 | GTO | GTO | GTO | GTO | GTO |
| Adhering area after annealing, | 100% | 100% | 100% | 50% | 20% |
| Resistance to organic solvents | no change | no change | no change | no change | no change |
| Welding speed | >1250 mm/min. | >1250 mm/min. | >1250 mm/min. | >1250 mm/min. | <500 mm/min. |

EXAMPLE 5

100 parts by weight of a plasticized phenolic resin 20 parts by weight aluminum fluoride (calculated as $AlF_3.3H_2O$)
7 parts by weight sodium borate (calculated as $Na_2B_4O_7.10H_2O$)
14 parts by weight dimethylethanolamine
12.5 parts by weight methyl methacrylate-acrylonitrile copolymer consisting of spheres having a mean particle diameter of 12 μm
11.5 parts by weight polyethylene wax and
115 parts by weight de-ionized water
were mixed.

0.5 parts by weight of a surfactant and 2.0 parts by weight of an alcohol had been added to the mixture in order to prevent foaming and to improve the wetting of the substrate.

That formulation was applied by means of a rubber roller to the surfaces on both sides of a silicon-alloyed electric sheet steel having a nominal thickness of 0.5 mm (grade V 700-50 A) in accordance with DIN 4640C, Part. 1. To cure the coating the coated sheets were subsequently heated at a temperature of 300° C. for 20 seconds. The mean thickness of the dry layer amounted to between 0.8 and 4 μm, depending on the mode of application.

The welding properties of the resulting insulating layer are apparent from the following Table 2.

EXAMPLE 6

100 parts by weight of a plasticized phenolic resin
20 parts by weight aluminum fluoride (calculated as $AlF_3.3H_2O$)
7 parts by weight sodium borate (calculated as $Na_2B_4O_7.10H_2O$)
14 parts by weight dimethylethanolamine
11 parts by weight polyethylene wax
27 parts by weight of a silicate with layer lattice structure (mean particle size 8 μm)
115 parts by weight de-ionized water
were mixed.

0.5 parts by weight of a surfactant and 2.0 parts by weight of an alcohol had been added to the mixture in order to prevent foaming and to improve the wetting of the substrate.

The mixture was processed under the conditions described in Example 5. The results have been compiled in the following Table 2.

EXAMPLE 7

100 parts by weight of a modified polyester resin
20 parts by weight aluminum fluoride (calculated as $AlF_3.3H_2O$)
7 parts by weight sodium borate (calculated as $Na_2B_4O_7.10H_2O$)
14 parts by weight dimethylethanolamine
11 parts by weight polyethylene wax
27 parts by weight magnesium silicate (talcum, mean particle size 8 μm)
115 parts by weight de-ionized water
were mixed.

0.5 parts by weight of a surfactant and 2.0 parts by weight of an alcohol had been added to the mixture in order to prevent foaming and to improve the wetting of the substrate.

The treating liquor was also processed as described in Example 5. The results are stated in Table 2.

EXAMPLE 8

100 parts by weight of a plasticized phenolic resin
20 parts by weight aluminum fluoride (calculated as $AlF_3.3H_2O$)
7 parts by weight sodium borate (calculated as $Na_2B_4O_7.10H_2O$)
14 parts by weight dimethylethanolamine
11 parts by weight polyethylene wax
27 parts by weight of micronized hollow glass spheres (mean particle diameter 10 μm)
115 parts by weight de-ionized
were mixed.

0.5 parts by weight of a surfactant and 2.0 parts by weight of an alcohol had been added to the mixture in order to prevent foaming and to improve the wetting of the substrate.

The treating liquor was processed as described in Example 5. The results are stated in Table 2.

In the following Table 2, column 2 indicates the highest permissible speed at which a satisfactory, non-porous seam weld can be formed under an argon atmosphere when the stack of sheets is welded with a current of 90 to 120 amperes and under a contact pressure of 250 $N \times cm^{-2}$.

Column 3 indicates the factor by which the non-porous, straight seam weld which can be formed without a renewal or pointing of the welding electrode is longer than in the Control Example, in which said weld is of unit length.

Column 4 indicates the area of the soot-covered surface at the welded edges as a percentage of the area of that surface of the product obtained in the Control Example.

TABLE 2

| Example | Welding speed mm/min | Stability of electrode | Soot-formation % |
|---|---|---|---|
| 5 | >1250 | 20 | 10 |
| 6 | >1250 | 20 | 10 |
| 7 | 1250 | 20 | 10 |
| 8 | 1250 | 20 | 10 |
| Comparison (Example 1) | >1250 | 1 | 100 |

It is apparent from Table 2 the that embodiment in which dispersed particles comprising silicate and/or polymer are used, the process in accordance with the invention affords great advantages particularly as regards the electrode stability, which is larger by a factor of 20 than in the embodiment of the process in which no particles are used. This means that the length of the seam weld which can be formed until the electrode is in the same state as during the welding of the sheets coated in accordance with Example 1 is increased by a factor of 20.

In that operation the area of the soot-covered surface is only 10% of the soot-covered area otherwise obtained.

We claim:

1. A process of applying an electrically insulating layer to sheet steel by means of a resin-containing aqueous treating liquor, being free of chromate compounds, which is dried when it has been applied, characterized in that the sheet steel is contacted with a treating liquor which contains a resin that is adapted to be diluted in alkaline aqueous medium and said liquor also contains a fluoride of a polyvalent metal in an amount of 0.1 to 80 parts by weight per 100 parts by weight of resin.

2. A process according to claim 1, characterized in that the sheet steel is contacted with a treating liquor which contains aluminum fluoride as a fluoride of a polyvalent metal.

3. A process according to claim 1, characterized in that the sheet steel is contacted with a treating liquor which contains 1 to 30 parts by weight metal fluoride per 100 parts by weight resin.

4. A process according to claim 1, characterized in that the sheet steel is contacted with a treating liquor which additionally contains 0.1 to 40 parts by weight borate per 100 parts by weight resin.

5. A process according to claim 4, characterized in that the sheet steel is contacted with a treating liquor which contains 1 to 10 parts by weight borate per 100 parts by weight resin.

6. A process according to claim 1, characterized in that the sheet steel is contacted with a treating liquor which additionally contains dispersed particles selected from the group consisting of silicate, polymer, and mixtures thereof.

7. A process according to claim 6, characterized in that the sheet steel is contacted with a treating liquor which contains talcum.

8. A process according to claim 6, characterized in that the sheet steel is contacted with a treating liquor which contains a vinyl polymer or vinyl copolymer.

9. A process according to claim 6, characterized in that the sheet steel is contacted with a treating liquor which contains a copolymer of polyvinylidene chloride or methyl methacrylate with acrylonitrile.

10. A process according to claim 6, characterized in that the sheet steel is contacted with a treating liquor which contains the dispersed particles in an amount of 3 to 80 parts by weight, per 100 parts by weight of water-dilutable resin.

11. A process according to claim 1, characterized in that the sheet steel is contacted with a treating liquor which contains the dispersed particles of a particle size from 2 to 20 $\mu$m.

12. A process according to claim 1, characterized in that the sheet steel is contacted with a treating liquor which contains additives promoting proper application selected from the group consisting of anti-settling agents, viscosity control agents, defoaming agents, wetting agents, leveling agents, and mixtures thereof.

13. A process according to claim 1, characterized in that the sheet steel is contacted with a treating liquor which contains additives which reduce the friction during the blanking operation selected from the group consisting of polypropylene waxes, polyamide, silicone oils and mixtures thereof.

14. A process according to claim 1, characterized in that the sheet steel is contacted with a treating liquor which contains 20 to 80% soild matter.

15. A process according to claim 1, characterized in that the treating liquor is contacted with the sheet steel by being applied with rollers and is caused to dry at a temperature (object temperature) of 120° to 350° C.

16. A process according to claim 6, characterized in that the sheet steel is contacted with a treating liquor which contains the dispersed particles in an amount of 5 to 30 parts by weight per 100 parts by weight of water-dilutable resin.

* * * * *